US009630795B2

(12) United States Patent
Tommasi

(10) Patent No.: US 9,630,795 B2
(45) Date of Patent: Apr. 25, 2017

(54) APPARATUS FOR FEEDING FOLDED PAPER TISSUES OR THE LIKE TO A PACKAGING SYSTEM

(71) Applicant: Rent S.r.l., Massa e Cozzile (PT) (IT)

(72) Inventor: Renzo Tommasi, Montecatini Terme (IT)

(73) Assignee: RENT S.R.L., Massa e Cozzile (PT) (IT)

( * ) Notice: Subject to any disclaimer, the term of this patent is extended or adjusted under 35 U.S.C. 154(b) by 0 days.

(21) Appl. No.: 15/021,784

(22) PCT Filed: Sep. 10, 2014

(86) PCT No.: PCT/IB2014/064365

§ 371 (c)(1),
(2) Date: Mar. 14, 2016

(87) PCT Pub. No.: WO2015/040525

PCT Pub. Date: Mar. 26, 2015

(65) Prior Publication Data

US 2016/0229654 A1 Aug. 11, 2016

(30) Foreign Application Priority Data

Sep. 17, 2013 (IT) ..... FI2013A0217

(51) Int. Cl.
*B65H 29/40* (2006.01)
*B65H 31/30* (2006.01)
(Continued)

(52) U.S. Cl.
CPC ..... *B65H 29/40* (2013.01); *B65H 31/309* (2013.01); *B65H 31/3072* (2013.01);
(Continued)

(58) Field of Classification Search
CPC ..... B65H 29/20; B65H 29/22; B65H 29/38; B65H 29/40; B65H 31/06; B65H 31/30;
(Continued)

(56) References Cited

U.S. PATENT DOCUMENTS 3,773,322 A 11/1973 Schlagbauer et al.
3,810,344 A 5/1974 Evans et al.
(Continued)

FOREIGN PATENT DOCUMENTS

EP 537125 A1 4/1993
JP S4882927 A 11/1973
JP S50133094 A 10/1975

OTHER PUBLICATIONS

International Search Report for International Application No. PCT/IB2014/064365.( Nov. 27, 2014) (2 pages).

*Primary Examiner* — Ernesto Suarez
(74) *Attorney, Agent, or Firm* — Lucas & Mercanti, LLP

(57) ABSTRACT

The present invention concerns the high speed packaging of folded paper articles such as tissues, napkins and the like, and more precisely it concerns an apparatus for continuously feeding such articles, arranged in stacked groups(P, P1) coming from folding machines, towards packaging machines, for example with a rotating drum, arranged downstream.

9 Claims, 3 Drawing Sheets

(51) Int. Cl.
*B65H 33/18* (2006.01)
*B65B 25/14* (2006.01)
*B65B 35/50* (2006.01)

(52) U.S. Cl.
CPC ..... *B65H 31/3081* (2013.01); *B65H 33/18* (2013.01); *B65B 25/145* (2013.01); *B65B 35/50* (2013.01); *B65H 2301/4228* (2013.01); *B65H 2301/42146* (2013.01); *B65H 2301/42172* (2013.01); *B65H 2403/512* (2013.01); *B65H 2404/311* (2013.01); *B65H 2701/18262* (2013.01); *B65H 2701/1924* (2013.01)

(58) Field of Classification Search
CPC ..... B65H 31/3054; B65H 31/3063; B65H 31/3072; B65H 31/3081; B65H 31/309; B65H 31/32; B65H 2301/363; B65H 2301/42; B65H 2301/4214; B65H 2301/42146; B65H 2301/17; B65H 2301/422; B65H 2301/4225; B65H 2301/42264; B65H 2301/42265; B65H 2301/42266; B65H 2301/42268; B65H 2301/4228; B65H 2301/4266; B65H 2301/4268; B65H 2404/232
See application file for complete search history.

(56) References Cited

U.S. PATENT DOCUMENTS 4,125,253 A * 11/1978 Wangermann ..... B65H 29/001 270/52.06
4,357,126 A * 11/1982 Kidd ..... B65H 29/001 271/187
5,425,565 A * 6/1995 Rogovein ..... B65H 31/06 294/119.1
5,522,588 A * 6/1996 Soltysiak ..... B65H 29/40 156/289
5,524,876 A * 6/1996 Porter ..... B65H 31/06 271/178
5,893,701 A * 4/1999 Pruett ..... B65B 23/14 198/419.1
7,789,226 B2 * 9/2010 Carrigan ..... B65B 5/105 206/215

* cited by examiner

APPARATUS FOR FEEDING FOLDED PAPER TISSUES OR THE LIKE TO A PACKAGING SYSTEM

CROSS-REFERENCE TO RELATED APPLICATIONS

This application is a 371 of PCT/IB2014/064365, filed Sep. 10, 2014, which claims the benefit of Italian Patent Application No. FI2013A000217, filed Sep. 17, 2013.

TECHNICAL FIELD OF THE INVENTION

The present invention concerns the high speed packaging of folded paper articles such as tissues, napkins and the like, and more precisely it concerns an apparatus for continuously feeding such articles, arranged in stacked groups coming from folding machines, to packaging machines, for example with a rotating drum, which is arranged downstream.

BACKGROUND OF THE INVENTION

The operation of this kind of apparatus, intended for the operative connection between the folding system and the packaging system, is critical due to the difficulty of ensuring high working speed (in any case, required by the market) with light and foldable material normally being treated (tissue paper).

Known machines or apparatuses of this type can be found in what is disclosed for example in European patent EP537125 to the same present applicant. These machines comprise belt or chain conveyor systems that feed single folded article from the outlet of the folding machines towards an accumulation and counting unit having the function of grouping the articles in stacks, each including a pre-settable number of pieces, controllable as needed. The accumulation and counting unit comprises a series of adjacent and mutually spaced collecting discs (variable in number depending on the size of the machine), revolving in a mutually integral fashion and provided with pockets, for collecting single folded products, the pockets being in the shape of curvilinear tangential laminations, adjacent to one another and partially superimposed, in such a way that each pocket, indeed defined by the spacing between two consecutive laminations, is adapted to house a single folded article.

The articles are then extracted from the discs and are grouped in orderly stacks through devices that are driven in a suitable and synchronised manner with the rotation of the collecting discs, and cooperating with the latter so as to gradually accumulate a group or a stack of articles and to convey it towards conveyor systems that take the groups of formed articles and conduct them towards the packaging system.

As mentioned, the problems that affect known apparatuses essentially result from the difficulty of ensuring reliable performances in high-speed operation, as imposed by more and more demanding productive requirements. From this point of view, there is an ongoing active search for new and alternative solutions that best combine flexibility, speed, reliability (avoiding machine stopping time, product waste and malfunctioning of the packaging machines), as well as constructive simplicity.

Such solutions must integrate the system for collecting, counting and conveying the product from the folding machine in a flexible, reliable manner with very high productivity and without substantial speed limits.

SUMMARY OF THE INVENTION

The object of the present invention is therefore that of increasing the range of available systems in the field of apparatuses for feeding stacks of folded products of the type to which general reference has been made, so as to achieve a constant and reliable feeding of stacks of products of variable number substantially without limits in the operation speed, all with constructive expedients that are simple and safe.

According to the invention, such an object is achieved with an apparatus for feeding stacks of tissues or similar folded paper products, to an automatic packaging system the essential characteristics of which are defined by the first of the attached claims.

BRIEF DESCRIPTION OF THE DRAWINGS

The characteristics and the advantages of the apparatus for feeding stacks of tissues or similar folded paper articles, to an automatic packaging system according to the present invention shall become apparent from the following description of its embodiments given as an example and not for limiting purposes, with reference to the attached drawings, in which.

DETAILED DESCRIPTION OF THE INVENTION

Figure 2:
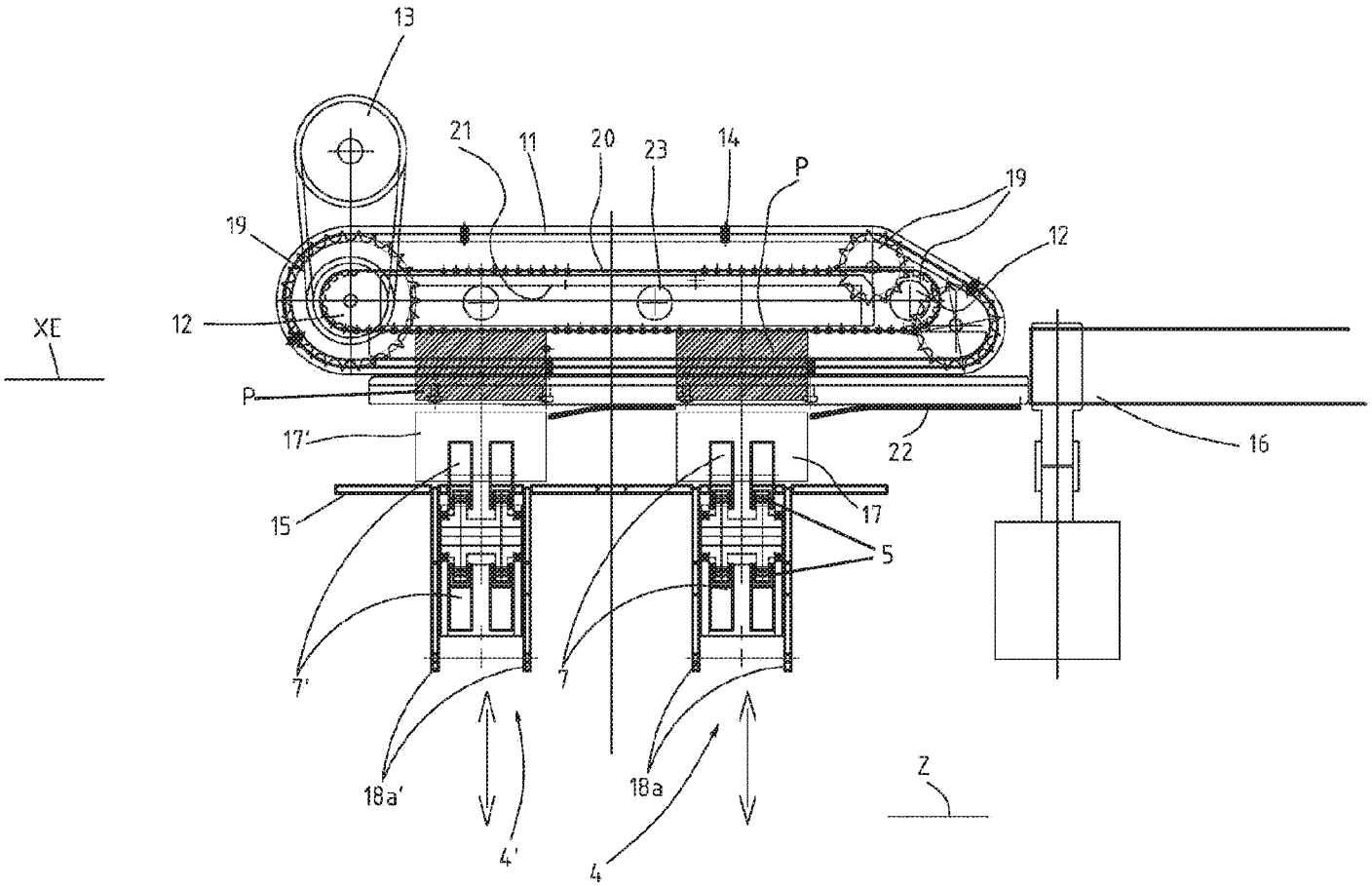
FIG. 2 is a front view (product exit side) of the apparatus, according to the arrow II of FIG. 1, with parts omitted (in particular the collecting discs) for the sake of clarity.
Figure 3:
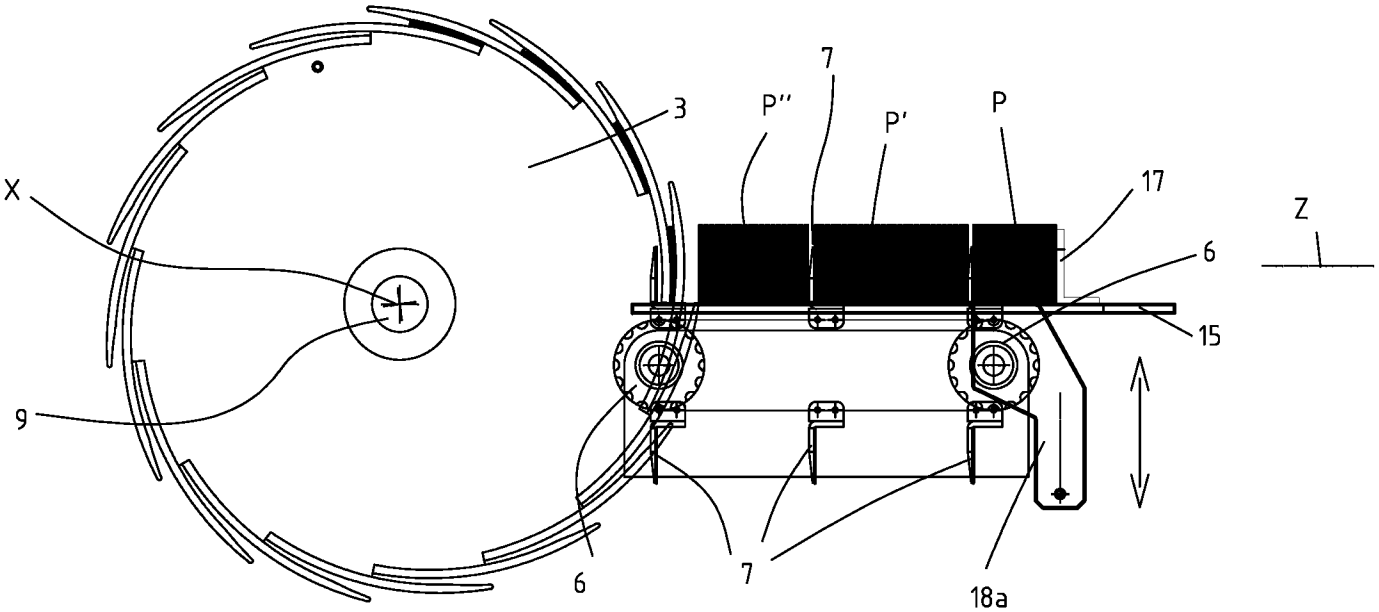
FIG. 3 shows a side view of the apparatus, like in FIG. 1, again with parts omitted, in a variant embodiment.

With reference to said figures, a feeding machine or apparatus according to the invention is arranged at the exit of a folding machine (that is not represented, but in any case of the known type), and comprises pairs of belts 1, 2 for feeding the product to a group of collecting discs 3 with its conventional collection pockets, normally three discs alongside one another and spaced apart for each working channel. The apparatus has two or more working channels alongside one another, each with a group of discs, for example two channels as can be clearly seen from FIG. 2. Same and corresponding components of the two channels are indicated with the same reference numeral, except for the presence of a mark (e.g. 4') to indicate the component of the channels furthest upstream according to the evacuation direction (as shall become clearer from the rest of the description), i.e., the channel on the left in the rear view of FIG. 2. For the sake of simplicity, the reference numerals without the mark of the channel farthest downstream (FIG. 3) will be mainly used, all being in any case applicable, of course, to the other channel.

A frame 8 supports the discs 3 that provide, according to the prior art, for receiving the product and for conveying it onto an accumulation plate 15 that is common to the various channels. A motor that is not represented sets the discs 3 into rotation, being fitted onto a shaft 9 that is common to the working channels alongside one another. The rotation is synchronised with the apparatus upstream (folding apparatus) and the relative conveyor belt system 1, 2. In the rest of the description, reference will be made to a single working channel bearing in mind that the description applies in the same way to the channels alongside one another, and that the relative actuations, except where specified otherwise, are shared among the various channels. The axis of the shaft 9 which corresponds to the rotation axis of the discs, defines an axial direction X, whereas a radial direction Z is defined on the imaginary plane of the accumulation plate. Said plane is the one on which also the direction X lies, though perpendicularly to the radial direction Z.

A system that provides for the radial expulsion of the articles unloaded by the collecting discs 3 on the already mentioned plate 15, and for their grouping into orderly stacks, is indicated with reference numeral 4 and comprises chains 5 that evolve in a ring-like fashion around pinions 6 having a rotation axis that is parallel with respect to that of the discs 3, all below the aforementioned plate 15. The chains 5 are each arranged in a position that axially corresponds with a space separating one disc from an adjacent disc of the group 3. The same chains support tabs 7 that project perpendicularly with respect to the chains (the reference is the path followed by the chains in their evolution seen in accordance with the rotation axes of pinions like for example in FIG. 2) so as to be adapted for insertion, passing also through suitable channels in the plate 15, in the aforementioned space, between the discs and in the pockets defined by them.

The chains 5 can have a different extension according to the size of the stacks to be separated, by effect of a different mutual spacing between the two pinions 6. Such a concept can be immediately understood by comparing FIG. 1 with FIG. 3, which indeed refers to a variant embodiment with longer chains intended for stacks with a greater number of articles, and therefore bulkier in the radial direction Z.

Returning now to the shape of the tabs, preferably, due to a suitable sizing of the pinions, in the interference area with the pockets of the discs, and thus where the tabs perform the task of extracting the stacks, the tabs carry out a substantially rotational motion centred in the centre of the pinion (see for example and in particular FIG. 4), according to which the free end part of the tab, i.e. the one which seizes the product, has a higher peripheral (tangential) speed. Such a condition promotes, as discussed hereafter, a more effective operation of the expulsion system.

The tabs 7 are thus used for pushing away from the discs 3 the products that have been formed in stacks and that have been unloaded onto the plate 15, following the rotation of the chains 5 as further clarified shortly. The height of the tabs 7, i.e. their elongation from the base point of connection to the chains, may not completely involve the height of the articles resting on the plate 15, but rather leave a portion of the stack free, for example, equal to around one third of the height, like in the example illustrated; but the tabs may as well have a height that is substantially the same as that of the articles. The chains 5, and with them the tabs 7, are set in rotation through one of the pinions 6 by a motor that is not represented, which is common to the two working channels, connected through transmission systems of the obvious type. Moreover, the distance between one tab and the successive one along the development of the chain is increased with respect to the width of a compressed stack, by an amount comprised between 50% and 100%, so as to ensure an optimal control of the advancing product.

A stop element 17 projects from the plate 15 immediately downstream of the pinion 6 farthest away from the discs 3, and is used for compacting the stacks before they are transported away. The stop element 17 is in turn shaped so as to allow for the passage through the tabs 7 which must obviously pass over it so as to complete the rotation around the pinion and carry out the return path towards the area of interference with the pockets of the collecting discs for the expulsion of a new stack.

A cam device 18 comprises two mutually spaced blades 18*a* that reciprocating in the direction of the height, i.e. that orthogonal with respect to the plate 15, and entering suitable slots formed in the same plate, lift the stacks being compacted by the stop element 17. In practice, the two blades 18*a* extend on planes orthogonal with the axis of the discs, at a suitable mutual distance, so that the expulsion chains can be arranged between them, and so as to interfere with the base of the stacks near to the respective sides thereof. The reciprocating movement is driven by contact with a rotatable cam 18*b* which is supported by the frame 8 below the radial expulsion device 6.

A side evacuation device 10 of the stacks, when lifted from the plate 15 as described just above, pulls the same stacks along an evacuation direction $X_E$ that is parallel to the rotation axis of the discs 3 (wherein the previous radial expulsion direction Z was clearly to be considered generically orthogonal with respect to such an axis). The device 10 is arranged above the plate 15, near the stack compacting stop 17.

The device 10 comprises a pair of spaced chains 11, which engage on pinions 19 with orthogonal axes with respect to those of the pinions 6 of the expulsion device, so as to give the chains a ring-like advancing movement in the evacuation direction. Between the chains 11 a plurality of crosspieces 14 extend, for engaging with the stacks to push them in the evacuation direction. It is important to note that the evacuation system can extend axially (i.e., along the axis of the collecting discs) so as to collect the stacks that are expelled from a multitude of stack-forming channels alongside one another, said channels being in any case conveyed into a single outlet feeding channel.

A conveyor belt 20 moreover operates in the space between the two chains 11, wound around deviation rolls 12 which define an annular path with shorter height (measured perpendicular to the plate 15) and shorter extension (development in the direction $X_E$) with respect to that of the same chains. The belt 20 is provided with holes that are evenly distributed and connected to a depression source (not shown) through an inner chamber 21 that is in turn slotted and also acts as an element for supporting the belt 20, and a collector 23. The belt 20 thus seizes, with a plane segment parallel and spaced with respect to the plate 15, the upper end portion of the stacks that are pushed upwards by the vertical extraction device 18. The stacks are then drawn away by the belt, which supports them through suction during the entire transport evacuation run. A support member 22 can be additionally provided for supporting the stacks at the base.

A motor 13 drives both the chains 11 and the belt 20 acting on one of the pinions 19 and the respective roll 12. Although the combined action of the chains 11 with cross-pieces 14 and of the belt 20 offers greater thrust safety, even a system with only the suction belt can possibly be satisfactory.

Downstream of the evacuation device 10 according to the evacuation direction $X_E$ a conveying system 16 is finally arrange, of a conventional type as such, suitable for taking the stacks out from the evacuation device and towards the further apparatuses of the line, typically packaging apparatuses.

The working of the apparatus according to the invention is already clear from what has been described above. In brief, the tabs 7 in a separation step are inserted in succession between one pocket and another of the collecting discs 3, performing initially a rotational movement and subsequently a linear movement along the upper straight portion of the chain. The rotational movement of the tabs, which in the illustrated embodiment corresponds to around 30° of rotation of the collecting discs, follows a law of motion that is coordinated with the motion of the discs, so as to complete the product separation step (i.e. the step in which the tabs cross the pockets of the discs), without bumping into the advancing product. Once the desperation has taken place, the chains finish off their cycle, again following a law of motion that is adapted to the specific product format being processed.

This been said in general terms, going into greater detail and following the whole working cycle, the chains 5 advance at a variable speed according to the format being processed until a number of pieces that is one piece less than the set amount (corresponding to the number of pieces of the desired stack) has been collected on the plate 15.

Having slowed down to the minimum speed at the end of the previous cycle, so as to allow the vertical extraction blades 18*a* to come out and return, avoiding interference with the advancing stacks, the chains now accelerate their movement and one of the tabs 7 enters the cooperation with the collection discs so as to carry out, as mentioned, the separation of the stack after that the last piece has been discharged. This is the step in which the tab operates in rotation, with an increased peripheral speed to promote the pockets being passed through, by sort of following the evolution of the outer perimeter of the pocket without impacting on the product in the front or rear part of the tab itself. In spite of the close vicinity between the discs and the extraction device there is in any case the space suitable for receiving the stack being formed.

Figure 1:
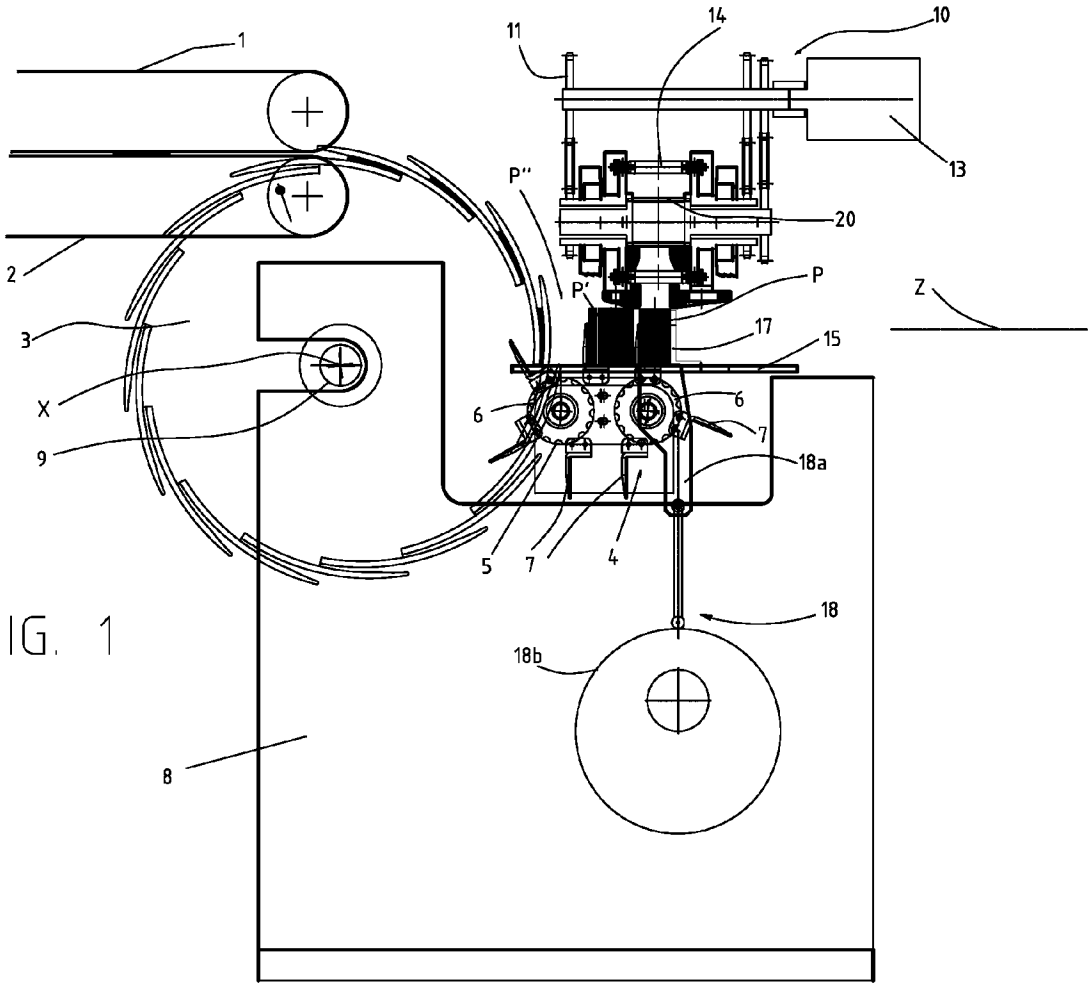
FIG. 1 is a schematic side representation of the apparatus.

At a certain point the tab enters the street portion of the chain and follows a linear movement with which it pushes the stack of products on the plate 15 towards the stop element 17, compacting the stack (see in FIG. 1 a compacted stack indicated with reference P, a stack to be compacted during the explosion step P', and finally a stack P" that is still in the formation/accumulation step on the plate).

At this stage the chains 5 slow down to the minimum speed, with of course another tab that is already in a position that is suitable for cooperating with the pockets of the discs and for carrying out the separation of a new stack following a new cycle like that which has just been described.

The compacted stack is at this stage lifted by the extraction device 18 and is picked up by the evacuation device 10, the chains 11 of which advance and by means of the crosspieces 14 and the belt 20 push the stack. The movement is synchronised with that of the expulsion device and gradually leads the stacks to the conveying system 16.

The advantages of the invention can be summarised in the following terms. The shape of the extraction device is structurally and operationally simple, but nonetheless very effective, with the rotational movement of the extraction seizing tabs 7 which is quick, and moreover allows for considerable compactness. The size proportions between the seizing tabs 7 and evacuation tabs 14 avoid mechanical engagements and allow for a functional shifting between the two devices. In practice, the expulsion system is capable of making many stacks advance simultaneously in the sense that while one stack is compacted and extracted from the chains the operation on the following stacks is not interrupted and continues in background. For this reason there is the possibility of keeping the evacuation thrust speed reasonably low, decreasing the risk of deformation of the product while in any case achieving good productivity. Such an objective is not accomplished for example with expulsion systems with radial reciprocating movement, with which if one desires to increase the productivity it is necessary to increase the thrust speed, with the consequent problems in keeping the stacks orderly.

With respect to other known systems which achieve similar results, in particular separating wheel systems that interfere with the collecting discs, there is also the advantage of unloading the products on a plane, which makes it possible to obtain stacks having great thickness (possibly as seen by making the chains develop in a radial elongation), when on the contrary the dimensions of the separating wheels cannot be developed beyond a certain limit if one desires to keep the bulk acceptable and not alter the overall architecture of the apparatus. The unloading onto the plane makes it possible, after all, for there to be greater safety and precision with respect to unloading on a surface that is in any case curved like the primitive of a separating wheel.

As already mentioned the rotational movement of the tabs 7 around the primitive circle of the pinions 6 represents a preferred and advantageous solution, however geometries and kinematics can be adopted that are different in the field of an overall architecture equivalent to the one described above.

The spatial references vertical/horizontal used above are clearly intended in connection with the most typical working arrangement and with the orientation shown in the figures, although it is as clear that these reference should not be considered at all as limitative.

The present invention has been described thus far with reference to a preferred embodiment thereof. It should be understood that other embodiments may exist that belong to the same inventive concept, all covered in the field of protection of the following claims.

The invention claimed is:

1. An apparatus for feeding articles such as tissues or similar folded paper products to an automatic packaging system, the apparatus comprising:

means for forming stacks of articles with at least two collecting discs defining an axial direction (X) and a radial direction (Z) and an accumulation plate adapted to receive and support the articles unloaded from said at least two collecting discs, the plate defining a plane in the radial direction (Z);

a stack separation and expulsion device adapted to eject the stacks over said plate in the radial direction (Z); and an evacuation device for evacuating the stacks previously ejected from the discs from the plate along a direction parallel to the axial direction, wherein said stack separation and expulsion device comprises at least one conveyor device running around pinions having rotation axes parallel with the axis of the discs and arranged below said plate, a segment of the at least one conveyor device runs in a plane parallel and adjacent with the plane of the plate, seizing tabs extend from said at least one conveyor device adapted to pass through channels formed in the plate and project orthogonally from the plate when the seizing tab are in the segment, and the seizing tab are arranged to pass through a space between two adjacent discs of the discs before entering the channels to elect the stacks over the plate away from the discs in the radial direction (Z).

2. The apparatus according to claim 1, wherein said at least one conveyor device is a conveyor chain and is in a position axially corresponding with the space between the two adjacent discs, and one of said pinions being carried into rotation by motorized driving means.

3. The apparatus according to claim 2, wherein said tabs are distributed in a regularly spaced manner along the development of said conveyor chain.

4. The apparatus according to claim 2, wherein said tabs are fixed to said conveyor chain so as to perform, around said pinions, a substantially rotational motion centered in the center of the same pinions.

5. The apparatus according to claim 2, wherein a stack stop and compression element is fixed to and projects from the plate immediately downstream of one of said pinions that is farthest away from the discs, said stop and compression element being shaped so as to allow for the passage through of said tabs.

6. The apparatus according to claim 5, wherein a distance between one of the tabs and a successive one of the tabs along the development of the chain is adjustable with respect to the width of a compressed stack, such that the distance is increased by an amount between 50% and 100%.

7. The apparatus according to claim 5, comprising a vertical lifting device adapted to lift the stacks compressed by said stop and compression element towards said evacuation device.

8. The apparatus according to claim 7, wherein said lifting device comprises two blades extending over planes orthogonal with the axis of the discs, at a certain mutual distance, and blade driving means adapted to reciprocate the blades relative to the plate in a direction orthogonal with plane of the plate.

9. The apparatus according to claim 2, wherein said driving means are adapted to drive the conveyor chain according to a speed function that provides for a variable speed adapted to be set depending on a format of the articles and stacks being processed.

* * * * *